US008051927B2

(12) United States Patent
Nava

(10) Patent No.: US 8,051,927 B2
(45) Date of Patent: Nov. 8, 2011

(54) PERCUSSIVE DRILL BIT FOR ROCK DRILLING AND METHOD FOR THE MANUFACTURE OF SUCH A DRILL BIT

(75) Inventor: Peter Nava, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 433 days.

(21) Appl. No.: 12/292,437

(22) Filed: Nov. 19, 2008

(65) Prior Publication Data

US 2009/0139773 A1 Jun. 4, 2009

(30) Foreign Application Priority Data

Nov. 21, 2007 (SE) ..... 0702638

(51) Int. Cl.
*E21B 17/042* (2006.01)

(52) U.S. Cl. ..... 175/320; 175/293; 175/415; 166/242.6

(58) Field of Classification Search ..... 175/293, 175/320, 415; 166/242.6; 173/128, 129; 279/8, 99; 408/226, 233
See application file for complete search history.

(56) References Cited

U.S. PATENT DOCUMENTS

| | | | | | |
|---|---|---|---|---|---|
| RE16,061 | E | * | 5/1925 | Thurston | 175/320 |
| 1,943,879 | A | * | 1/1934 | Rea | 175/419 |
| 1,943,880 | A | * | 1/1934 | Rea | 175/400 |
| 4,549,615 | A | * | 10/1985 | Liang et al. | 175/389 |
| 4,625,814 | A | * | 12/1986 | Helasuo et al. | 175/57 |
| 5,020,780 | A | * | 6/1991 | Woodings | 266/271 |
| 5,785,360 | A | * | 7/1998 | Nordfeldt et al. | 285/328 |
| 6,161,633 | A | | 12/2000 | Broom | |
| 6,494,275 | B2 | * | 12/2002 | Åsberg et al. | 175/401 |
| 6,732,820 | B1 | | 5/2004 | Broom | |
| 6,736,226 | B2 | | 5/2004 | Broom | |
| 6,767,156 | B1 | * | 7/2004 | Larsson | 403/343 |
| 6,810,956 | B1 | * | 11/2004 | Sandstrom | 166/242.6 |
| 6,892,831 | B2 | | 5/2005 | Broom | |
| 7,281,594 | B2 | | 10/2007 | Hadin | |
| 7,624,822 | B2 | * | 12/2009 | Olsson et al. | 175/293 |
| 2004/0163852 | A1 | | 8/2004 | Broom | |
| 2008/0264694 | A1 | * | 10/2008 | Miller et al. | 175/320 |

FOREIGN PATENT DOCUMENTS

| | | | |
|---|---|---|---|
| SE | 530 602 | C2 | 7/2008 |
| WO | WO 2007/147257 | A1 | 12/2007 |

* cited by examiner

*Primary Examiner* — Daniel P Stephenson
*Assistant Examiner* — Robert E Fuller
(74) *Attorney, Agent, or Firm* — Drinker Biddle & Reath LLP

(57) ABSTRACT

A drill bit for percussive rock drilling of the type that comprises a front head and a tubular skirt, which extends rearward from the head to a rear, ring-shaped end and includes an internal thread for the transfer of combined impact and rotary motions to the drill bit is disclosed. The rear end of the skirt is, via an unelastic joint, e.g., a friction weld, united to a front end of a sleeve having an envelope surface, from which a plurality of projections are peripherically spaced-apart from each other project, e.g., ridges, having the purpose of guiding the drill bit in the drill hole. By assembling the drill bit of two parts, the internal thread can be turned with high accuracy and smoothness, at the same time as the drill bit is given an inherent good controllability. In an additional aspect, a method for the manufacture of such a drill bit is also disclosed.

17 Claims, 2 Drawing Sheets

PERCUSSIVE DRILL BIT FOR ROCK DRILLING AND METHOD FOR THE MANUFACTURE OF SUCH A DRILL BIT

RELATED APPLICATION DATA

The present application claims priority under 35 U.S.C. §119 and/or §365 to Swedish Application No. 0702638-8, filed Nov. 21, 2007, the entire contents of which are incorporated herein by reference.

FIELD

The present disclosure relates to a percussive drill bit intended for percussive rock drilling of the type that comprises a front head and a tubular skirt, which extends rearward from the head to a rear, ring-shaped end, and includes an internal thread for the transfer of combined impact and rotary motions to the drill bit, the head including a rotationally symmetrical envelope surface in which chipways are countersunk and which defines the greatest outer diameter of the drill bit. In addition, the present disclosure relates to a method for the manufacture of drill bits of the kind in question.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

For the boring of deep holes in rock or earth, drill strings are used, which comprise a plurality of rods and coupling sleeves, which are assembled as the depth of the hole increases. A terrestrial machine having a shank adapter has the purpose of transferring combined impact and rotary motions to the upper end of the drill string, the lower end of which carries a drill bit, which performs the active operation to crush the rock and form the hole. By flushing fluid through the drill string to the drill bit, the detached drill cuttings can be conveyed to the hole entry by passing between the outside of the drill string and the inside of the hole.

In rock drilling equipment of this type, a number of requirements and needs are made, one of which is that the recessed hole should be as straight as possible, for instance in order to in the best way impinge on a predetermined target deep down in the rock. For this purpose, a number of control devices have previously been proposed, which make use of tubular controlling elements adjacent to those coupling sleeves, which couple together the different rods, or alternatively along the proper rods. Disadvantages of this type of control devices are that the drilling equipment in its entirety becomes complicated, expensive and ungainly to handle. A previously known rock drill bit, which to a certain extent has improved the straightness of drilled holes is shown in U.S. Pat. No. 7,281,594. A number of steps have there been provided on the skirt of the drill bit, which steps guide the bit in succession.

Another requirement is that the components included in a rock drilling equipment, and in particular the expensive drill bit, should have an optimum service life. In order to provide for this requirement, it is among other things important that the internal thread of the rear skirt of the drill bit is turned by smooth and precision-shaped thread ridges and thread grooves, because otherwise tendencies to crack and other phenomena may arise, which result in early corrosion fatigue

SUMMARY

The present disclosure aims at obviating the above-mentioned disadvantages of the previously known technique by providing an improved drill bit for percussive rock drilling. Therefore, a primary object is to provide a drill bit, which on one hand has a considerably improved, inherent controllability in comparison with previously known drill bits, and on the other hand can be made with a precision-shaped female thread having smooth surfaces with the purpose of promoting a long service life of the same. More precisely, the thread should be possible to be turned by means of turning tools, the bars of which are comparatively short with the purpose of avoiding vibrations and bending phenomena in the tool during turning. An additional object is to provide a drill bit, which in spite of the inherent good controllability thereof has a moderate mass and which enables that the intermittent shock waves are transferred directly from the drill string to the head of the drill bit and the buttons positioned in the same way as in conventional drill bits.

Accordingly, at least a primary object is attained by means the rear end of the skirt being united, via an unelastic joint, to a front end of a sleeve having an envelope surface, from which a plurality of projections project, the projections being peripherically spaced-apart from each other, in order to guide the drill bit in a hole recessed by the head.

In a second aspect, a method for the manufacture of drill bits of the kind in question is disclosed.

An exemplary embodiment of a percussive drill bit for rock drilling, comprises a front head; and a tubular skirt, which extends rearward from the front head to a rear, ring-shaped end, and includes an internal thread for the transfer of combined impact and rotary motions to the drill bit, the front head including a rotationally symmetrical envelope surface in which chipways are countersunk, and which defines a greatest outer diameter of the drill bit, wherein the rear end of the skirt is, via an unelastic joint, united to a front end of a sleeve having an envelope surface, from which a plurality of projections project, the projections peripherically spaced-apart from each other, to guide the drill bit in a hole recessed by the head.

An exemplary method for the manufacture of drill bit intended for percussive rock drilling, which includes a front head and a tubular skirt, which extends rearward from the head to a rear, ring-shaped end, and includes an internal thread for the transfer of combined impact and rotary motions to the drill bit, the front head including a rotationally symmetrical envelope surface, in which chipways are countersunk, and which defines a greatest outer diameter of the drill bit, comprises the steps of: a) turning the internal thread at the inside of the skirt, and b) after that, via an unelastic joint, uniting a rear end of the skirt to a front end of a sleeve having an envelope surface from which a plurality of projections project, the projections being peripherically spaced-apart from each other project and guiding the drill bit in a hole recessed by the front head.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
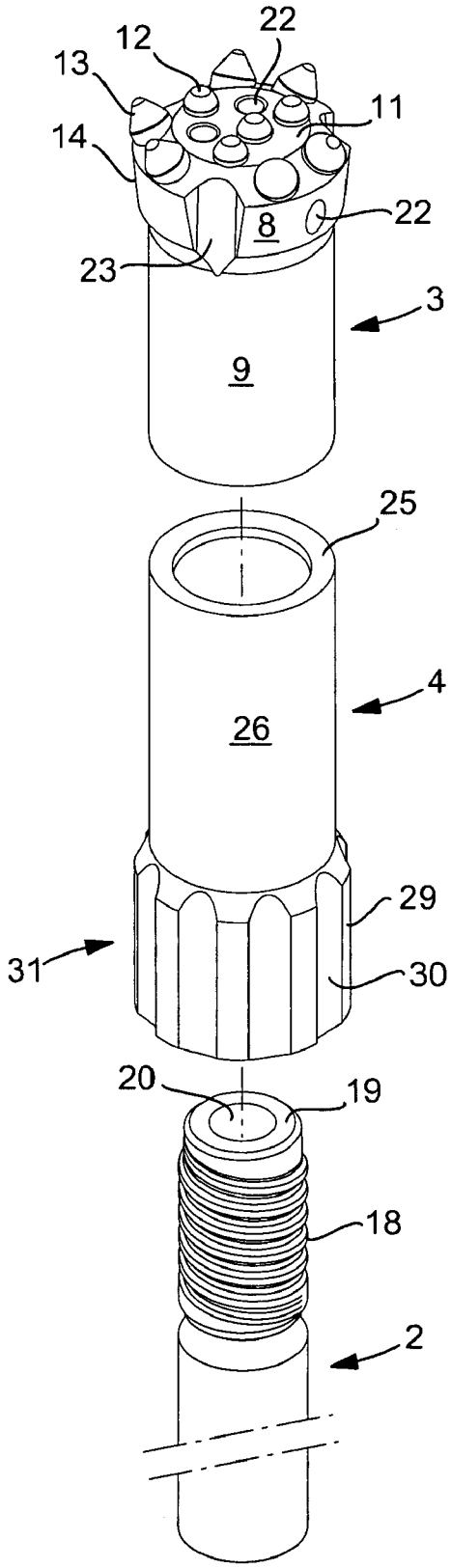
FIG. 1 is a perspective exploded view showing two components included in the drill bit according to the invention separated from each other, as well as a portion of a drill rod for connection with the drill bit.
Figure 2:
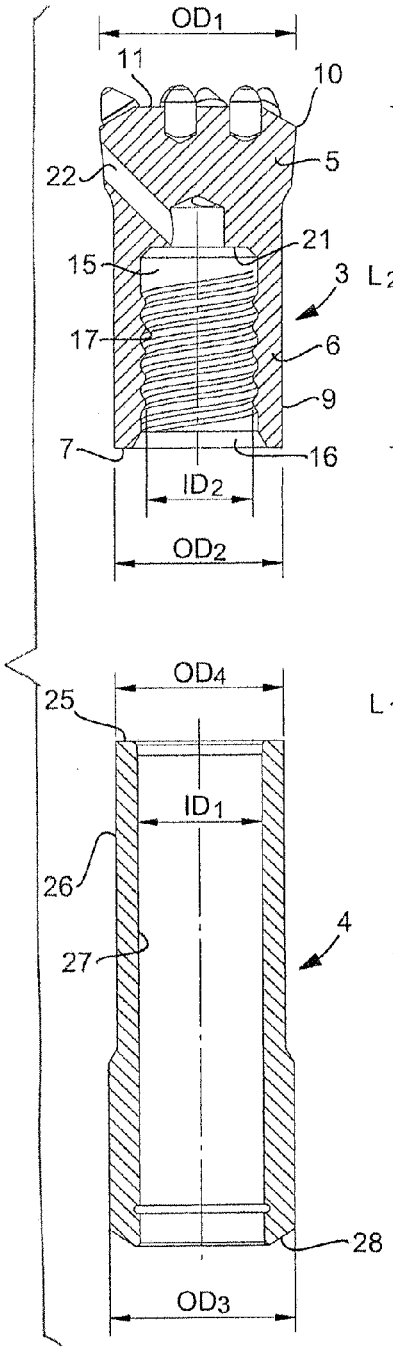
FIG. 2 is an exploded longitudinal sectional view showing the two parts of the drill bit in separated state.
Figure 3:
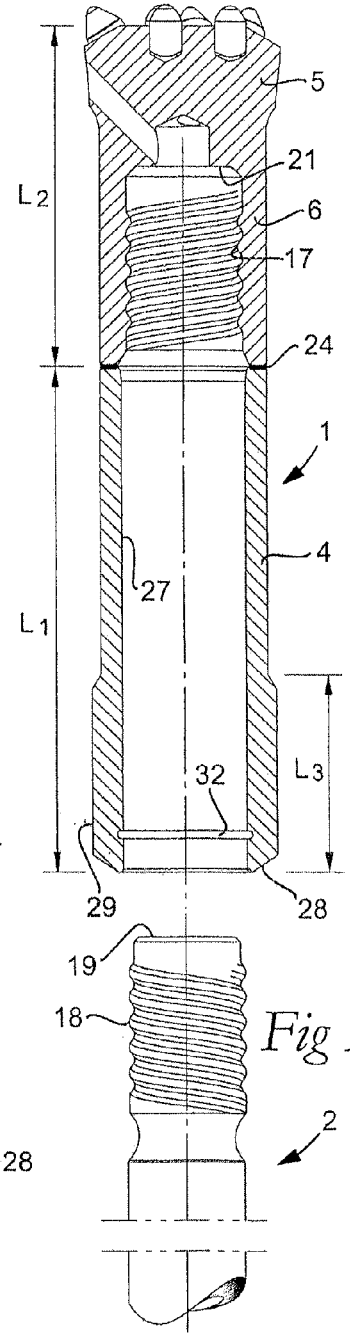
FIG. 3 is a longitudinal sectional view through the drill bit in assembled state and separated from the drill rod.
Figure 4:
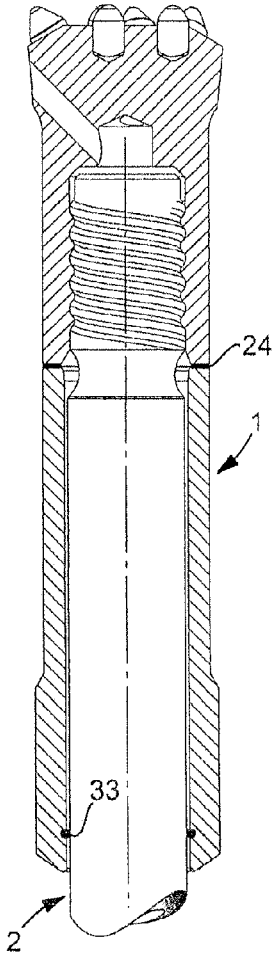
FIG. 4 is a corresponding longitudinal sectional view showing the drill rod connected with the drill bit.

In the drawings, 1 generally designates a drill bit, which is intended to be coupled together with a drill rod 2 included in a drill string (see FIGS. 3 and 4). In FIGS. 1 and 2, it is seen that the drill bit 1 is manufactured by being assembled of two parts, viz. a front part 3 and a rear part 4. Of these parts 3, 4, the front one 3 is made as a conventional drill bit. Thus, the part 3 includes a front head 5 and a tubular skirt 6, which extends rearward from the head 5 to a rear, ring-shaped end 7. The part 3 has a rotationally symmetrical basic shape by including a rotationally symmetrical envelope surface, which is assembled of a cone surface 8 on the outside of the head 5, as well as a cylinder surface 9 on the outside of the skirt 6. The cone surface 8 converges in the backward direction from a circular borderline 10 along which the cone surface 8 transforms into a front surface 11, in which buttons of cemented carbide or the like are mounted, viz. a set of centre buttons 12 and a set of peripheral buttons 13. On a level with the borderline 10, the head 5 has the greatest outer diameter $OD_1$ thereof. The corresponding outer diameter $OD_2$ for the cylinder surface 9 is less than $OD_1$.

The skirt 6 delimits a hollow space 15, which has a cylindrical shape and opens in an opening 16 surrounded by the ring-shaped end surface 7. In the inside of the skirt 6, a female thread 17 is provided to co-operate with a male thread 18 of the drill rod 2. As may be best seen in FIG. 1, the male thread is formed in close connection to the front end of the drill rod, which end consists of a plane, ring-shaped surface 19, which surrounds a duct 20 running centrally in the drill rod for the feed of flush water to the drill bit. The inner end of the hollow space 15 of the part 3 consists of a plane, ring-shaped shoulder surface 21, which is impinged on by the end surface 19 of the drill rod when impulsive forces are transferred to the drill bit. The hollow space 15 communicates with the outside of the drill bit via ducts 22, which terminate in the front surface 11, as well as in the cone surface 8.

Concerning the part 3, it should in conclusion be mentioned that a number of chipways 23 are countersunk in the cone surface 8. A vital task of the flushing fluid is to evacuate the crushed cuttings via the grooves 23 to the ground surface.

In contrast to unelastically tightenable threaded joints of the type that is found in machine details of different types, the joint that is formed of the female and male threads 17, 18 is formed in such a way that the male thread intermittently is screwed into and unscrewed of, respectively, the female thread in order to after each impact motion rotate the drill bit to a new rotation angle position in relation to the rock. The impact motions of the drill string are transferred to the drill bit primarily via the surfaces 19, 21, while the principal task of the threaded joint is to provide for the stepwise rotation of the drill bit. It should also be mentioned that the described part 3 is manufactured by chip removing machining (turning, milling and boring, respectively), the female thread 17 being formed by internal turning. The female thread 17 and male thread 18 may each contain just a few thread turns, for example one to three thread turns having full profile on each component 1 and 2.

As far as the shown part 3 hitherto has been described, the same does not differ on any substantial points from previously known rock drill bits.

According to the invention, the rear end 7 of the skirt 6 is, via an unelastic joint 24 (see FIGS. 3 and 4), united or rigidly connected to a front end 25 of the part 4, which is in the form of a sleeve, the external surface or envelope surface 26 of which is formed with projections in order to guide the drill bit in the hole recessed by the head 5 and the buttons thereof. Also the sleeve 4 has a rotationally symmetrical basic shape. More precisely, the same is in the example cylindrical by the fact that the external surface or the envelope surface 26, as well as the internal surface 27 are cylindrical. Thus, the sleeve delimits an axially through-going hollow space, which opens in the hollow space 15, as well as in a rear opening, which is surrounded by a rear, and in this case cone-shaped, end surface 28 of the sleeve. Alternatively, said end surface may be provided with so-called retrac teeth. The cylinder surface 26 of the sleeve 4 and the envelope surface 9 of the skirt 6 are preferably smooth and cylindrical in the area of the joint 24.

In the shown, preferred embodiment, the guiding projections on the outside of the sleeve consist of a number of peripherically spaced-apart ridges 29, which may run axially along the sleeve and are mutually spaced-apart by grooves 30, which like the grooves 23 form chipways. The total cross-sectional area of the chipways 30 should be at least as great as the total cross-sectional area of the grooves 23. The crest surfaces facing outward of the ridges 29 together form a ring formation, which in the example is cylindrical by the fact that each crest surface has a part-cylindrical shape. Together the crest surfaces of the ridges 29 define the greatest outer diameter $OD_3$ of the sleeve, which is greater than the outer diameter $OD_4$ of the envelope surface 26. More precisely, the grooves 30 are in this case formed, e.g., by milling, in a collar in its entirety designated 31, the grooves being identical and delimiting ridges, which are uniform so far that they have one and the same length as well as one and the same width. In this connection, the ridges are somewhat deeper than the grooves, i.e., the bottoms of the grooves do not reach into an imaginary extension of the envelope surface 26. It should also be observed that the collar 31, i.e., the set of ridges 29, is located at the rear end of the sleeve 4. In the shown, preferred embodiment, the outer diameter $OD_3$ of the collar 31 and the outer diameter $OD_1$ of the head 5 are equally large. However, $OD_3$ may be somewhat smaller, but never greater, than $OD_1$. Alternatively, the ridges 29 may form an angle with the rotational axis of the drill bit.

Advantageously, the sleeve 4 has, in the front part thereof along the envelope surface 26, an outer diameter $OD_4$, which is as great as the outer diameter $OD_2$ of the skirt 6. However, the inner diameter $ID_1$ is greater than the inner diameter $ID_2$ of the skirt 6 such as this is represented by the outer diameter of the thread 17, i.e., the greatest diameter of the thread grooves.

Suitably—however, not necessarily—the length $L_1$ of the sleeve 4 is greater than the length $L_2$ of the front part 3. Within given presumptions regarding the optimal mass of the finished drill bit, a maximal controllability is accordingly attained because the guiding ridges 29 are located at greatest feasible distances from the head 5.

In practice, the sleeve may advantageously be permanently united to the front part 3, in order to form together with the same an integrated drill bit, which is discarded after wear. Therefore, the joint 24 between the parts 3, 4 may be metallurgical and consist of, for instance, a friction weld or another suitable weld. However, within the scope of the invention, it is feasible to unite the parts 3, 4 via a semi-permanent joint, e.g., an unelastic threaded joint having suitable lock means, or a metallic joint, which easily may be disengaged.

In the embodiment shown, a ring-shaped groove 32 for a sealing ring 33 is recessed in the internal surface 27 of the sleeve 4. More precisely, said sealing ring 33 is situated in the immediate vicinity of the rear end 28 of the sleeve, with the purpose of avoiding penetration of cuttings in the gap between the envelope surface of the drill rod 2 and the interior of the sleeve.

It should also be mentioned that the axial extension or length $L_3$ of the ridges 29 suitably is smaller than half of the length $L_1$ of the sleeve. In the example, $L_3$ amounts to approximately 35% of $L_1$.

The manufacture of the two parts 3, 4, which together form the drill bit ready for use, is carried out in separate steps by cutting or chip removing machining of workpieces of steel, above all turning, but also milling and boring. The very forming of the internal thread 17 of the part 3 may be carried out by internal turning by means of a turning tool, the bar of which has very moderate length. In such a way, the turning operation can be carried out without risk of troublesome vibrations, which could jeopardize the desired precision and the surface smoothness of the thread. The machining of the sleeve 4 is reasonably simple and consists primarily of turning, as well as certain milling of the grooves of the rear collar. After completion of the part 3 (with or without buttons) and the part 4, the same are permanently united by welding together the rear end of the skirt 6 with the front end of the sleeve 4. Suitably—however not necessarily—this is carried out by friction welding.

An advantage of the drill bit is that the internal thread of the drill bit can be given desired precision and smoothness at the same time as the ridges or projections, which have the purpose of guiding the drill bit, can be located at an advantageously great axial distance from the head of the drill bit. In addition, it is construction-wise simple to form the extension sleeve in such a way that the assembled drill bit obtains a total mass, which does not lead to unbalances. In addition, the improved controllability of the operating drill string is exclusively attained by means of the drill bit, i.e., other controlling elements being difficult to handle do not need to be resorted to. Expressed in another way, it can be said that the drill bit by itself improves the conditions for the boring of straight holes without the transfer of the requisite shock waves needing to be altered. Thus, the shock waves can be transferred from rod end to rock surface via cemented-carbide buttons in the same advantageous way as in conventional drill bits.

The invention is not limited only to the embodiment described above and shown in the drawings. Thus, the shape and the placement of the external, guiding projections of the sleeve may be modified in miscellaneous ways. Instead of only long narrow ridges, the projections may consist of, for instance, semi-spherical knobs or combinations of knobs and ridges. Instead of one single rear set of ridges or projections, such as has been exemplified in the drawings, two or more axially spaced-apart sets may be formed on the sleeve. It is even feasible to displace the different ridges or projections axially in relation to each other. In other words, they need not necessarily be collected in a ring-shaped formation or collar.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A percussive drill bit for rock drilling, comprising, manufacture:

a front head; and a tubular skirt, which extends rearward from the front head to a rear, ring-shaped end, and includes an internal thread for the transfer of combined impact and rotary motions to the drill bit, the front head including a rotationally symmetrical envelope surface in which chipways are countersunk, and which defines a greatest outer diameter of the drill bit, wherein the rear end of the skirt is united to a front end of a separate sleeve, solely via a joint which is separate from the internal thread and arranged for preventing relative rotation between the skirt and the sleeve, the sleeve having an envelope surface, from which a plurality of projections project, the projections peripherally spaced-apart from each other, to guide the drill bit in a hole recessed by the head.

2. The drill bit according to claim 1, wherein the projections consist of ridges, which run axially along the sleeve and together form a ring formation, an outer diameter of which is not more than the greatest outer diameter of the head.

3. The drill bit according to claim 2, wherein the outer diameters of the front head and of the ring formation formed by the ridges are equally large.

4. The drill bit according to claim 2, wherein the ridges are included in a collar, an axial length of which is smaller than a length of the sleeve.

5. The drill bit according to claim 4, wherein the outer diameters of the front head and of the ring formation formed by the ridges are equally large.

6. The drill bit according to claim 5, wherein the collar is placed in the immediate vicinity of the rear end of the sleeve.

7. The drill bit according to claim 4, wherein the collar is placed in the immediate vicinity of the rear end of the sleeve.

8. The drill bit according to claim 4, wherein the length of the sleeve is greater than a total length of the front head and of the skirt.

9. The drill bit according to claim 4, wherein the joint comprises a permanent metallurgical joint in order to make the sleeve an integrated part of the drill bit.

10. The drill bit according to claim 9, wherein the part of the sleeve united to the skirt has an outer diameter, which is as great as an outer diameter of the skirt and the sleeve has an inner diameter, which is greater than an inner diameter of the skirt is represented by an outer diameter of the internal thread.

11. The drill bit according to claim 9, wherein the envelope surface of the sleeve and an envelope surface of the skirt are smooth and cylindrical in an area of the metallurgical joint.

12. The drill bit according to claim 1, wherein the joint comprises a permanent metallurgical joint in order to make the sleeve an integrated part of the drill bit.

13. The drill bit according to claim 12, wherein the part of the sleeve united to the skirt has an outer diameter, which is as great as an outer diameter of the skirt and the sleeve has an inner diameter, which is greater than an inner diameter of the skirt is represented by an outer diameter of the internal thread.

14. The drill bit according to claim 12, wherein the envelope surface of the sleeve and an envelope surface of the skirt are smooth and cylindrical in an area of the metallurgical joint.

15. The drill bit according to claim 1, wherein the joint is unelastic.

16. A method for the manufacture of a drill bit intended for percussive rock drilling, which includes a front head and a tubular skirt, which extends rearward from the head to a rear, ring-shaped end, and includes an internal thread for the transfer of combined impact and rotary motions to the drill bit, the front head including a rotationally symmetrical envelope surface, in which chipways are countersunk, and which defines a greatest outer diameter of the drill bit, the method comprising the steps of:

a) turning the internal thread at the inside of the skirt, and b) after that, solely via a joint which is separate from the internal thread and arranged for preventing relative rotation between the skirt and a separate sleeve, uniting a rear end of the skirt to a front end of the sleeve which has an envelope surface from which a plurality of projections project, the projections being peripherally spaced-apart from each other for guiding the drill bit in a hole recessed by the front head.

17. The method according to claim 16, wherein the joint is unelastic.

* * * * *